United States Patent [19]

Hofferber et al.

[11] 4,092,722

[45] May 30, 1978

[54] FLUID CATALYTIC CRACKING WITH AUTOMATIC TEMPERATURE CONTROL

[75] Inventors: James A. Hofferber; Paul U. Webb, both of Bartlesville, Okla.

[73] Assignee: Phillips Petroleum Company, Bartlesville, Okla.

[21] Appl. No.: 733,666

[22] Filed: Oct. 18, 1976

[51] Int. Cl.[2] ..... C10G 13/18; G06G 7/58

[52] U.S. Cl. ..... 364/500; 23/288 S; 208/159; 208/164; 208/DIG. 1; 364/105; 364/118

[58] Field of Search ..... 235/151.12, 150.1; 208/108, 113, 159, 164, DIG. 1; 23/288 R, 288 B, 288 S, 288 H

[56] References Cited

U.S. PATENT DOCUMENTS

| | | | |
|---|---|---|---|
| 3,175,968 | 3/1965 | Berger | 208/164 |
| 3,213,014 | 10/1965 | Atkinson et al. | 208/113 |
| 3,316,170 | 4/1967 | Stewart et al. | 208/164 |
| 3,408,261 | 10/1968 | Johnson et al. | 202/160 |
| 3,410,793 | 11/1968 | Stranahan et al. | 208/159 |
| 3,513,087 | 5/1970 | Smith | 208/159 |
| 3,549,998 | 12/1970 | Fluegel | 324/120 |
| 3,629,097 | 12/1971 | Smith | 208/159 |
| 3,760,168 | 9/1973 | Boyd | 235/151.12 |
| 3,828,171 | 8/1974 | Griffin | 235/151.12 |

*Primary Examiner*—Joseph F. Ruggiero

[57] ABSTRACT

A fluid catalytic cracking unit is controlled by sensing the reactor bed temperature and the riser temperature and by manipulating the flow of regenerated cracking catalyst into the riser responsive to these two temperature measurements. A gain function generator is utilized to compensate for the non-linear relationship between the change in valve position and change in riser temperature caused thereby.

10 Claims, 4 Drawing Figures

FLUID CATALYTIC CRACKING WITH AUTOMATIC TEMPERATURE CONTROL

This invention relates to catalytic cracking of hydrocarbons. More specifically this invention relates to temperature controlled fluid catalytic cracking of hydrocarbons.

BACKGROUND OF THE INVENTION

Heavy hydrocarbons can be converted into hydrocarbons within the average lower molecular weight by contacting these hydrocarbons under elevated temperatures with a cracking catalyst. During this operation a carbonaceous material often referred to as coke is deposited on the cracking catalyst. The coke reduces the activity of the cracking catalyst. In order to restore the activity, this cracking catalyst is introduced into a regenerator and the coke is burned off, e.g., with air. The regenerated cracking catalyst is then reintroduced into the catalytic cracking unit. The temperature in the catalytic cracker is of significant importance both with respect to the product made in the process and with respect to the quantity of coke deposited on the catalyst. The temperature in the cracking catalyst is, however, difficult to control.

Temperature control systems for controlling the temperature of the catalytic cracker have been described in the art. For instance the U.S. Pat. No. 3,828,171 shows measuring the temperature in a fluid catalytic cracking reactor bed and to control the flow of regenerated catalyst from the regenerator to the riser reactor. Two problems, however, remain to be solved. One is that the response to the temperature control is rather slow since the change achieved in the reactor vessel by the change of the flow of regenerated catalyst is delayed by the time it takes for the catalyst to reach the reactor vessel. A second problem is connected to the fact that the manipulation of a valve in the conduit through which the regenerated catalyst flows from the regenerator to the catalytic cracker is not linearly related to the temperature in the reactor. This non-linearity is related mainly to the valve itself in connection with the particular cracking catalyst material, but is also related to the slightly endothermic cracking reaction and the heat losses of the system.

THE INVENTION

It is thus one object of this invention to provide a fluid catalytic cracking process which is computer controlled.

Another object of this invention is to provide a fluid catalytic cracking process wherein the control compensates for non-linearities in the functional relationship between the sensed variables and the manipulated variables. A further object of this invention is to provide a cracking process that is automatically temperature controlled by a fast acting control system.

Yet another object of this invention is to provide a control system for a fluid catalytic cracker that is both efficient and economical.

Figure 1:
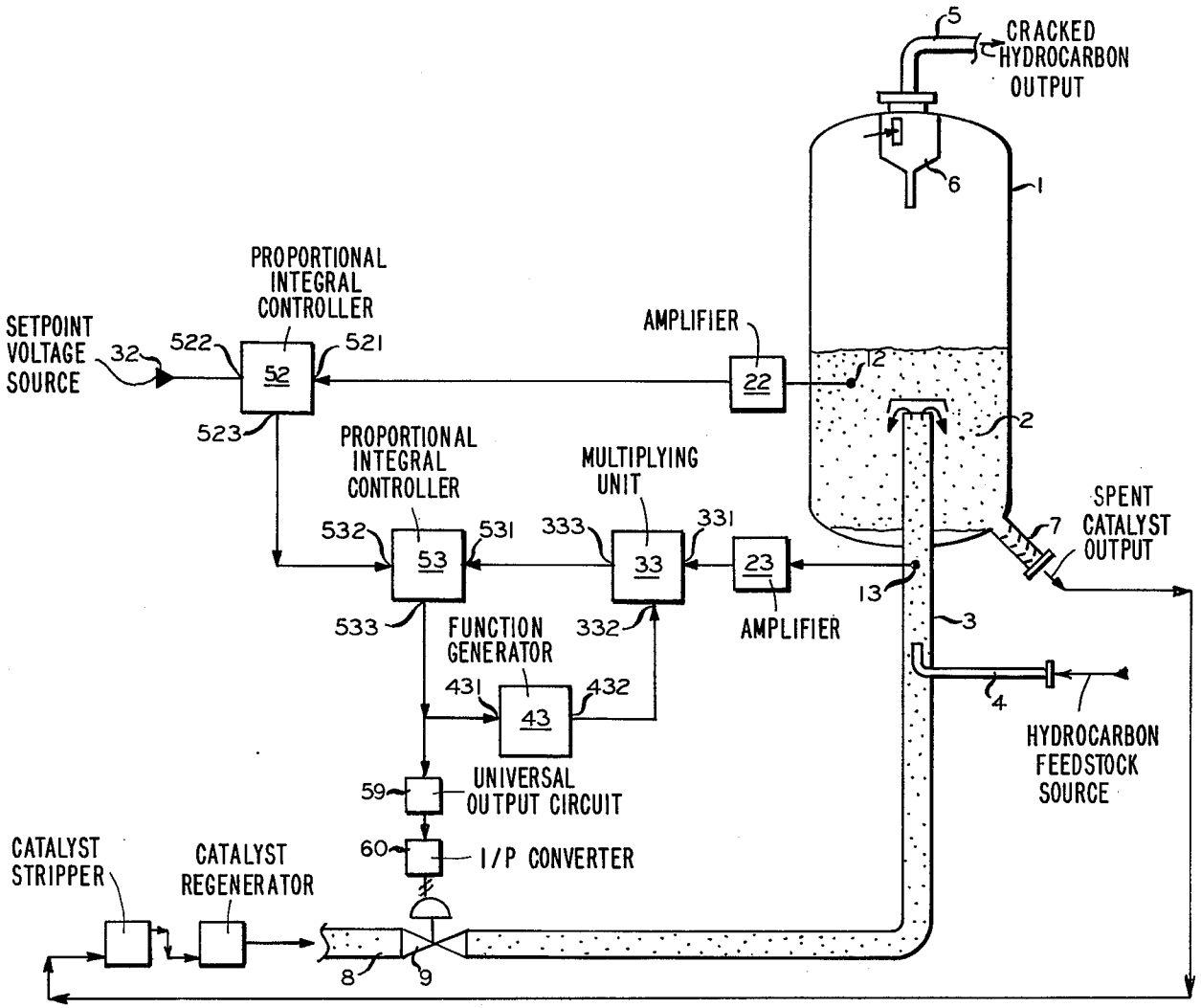
Figure 2A:
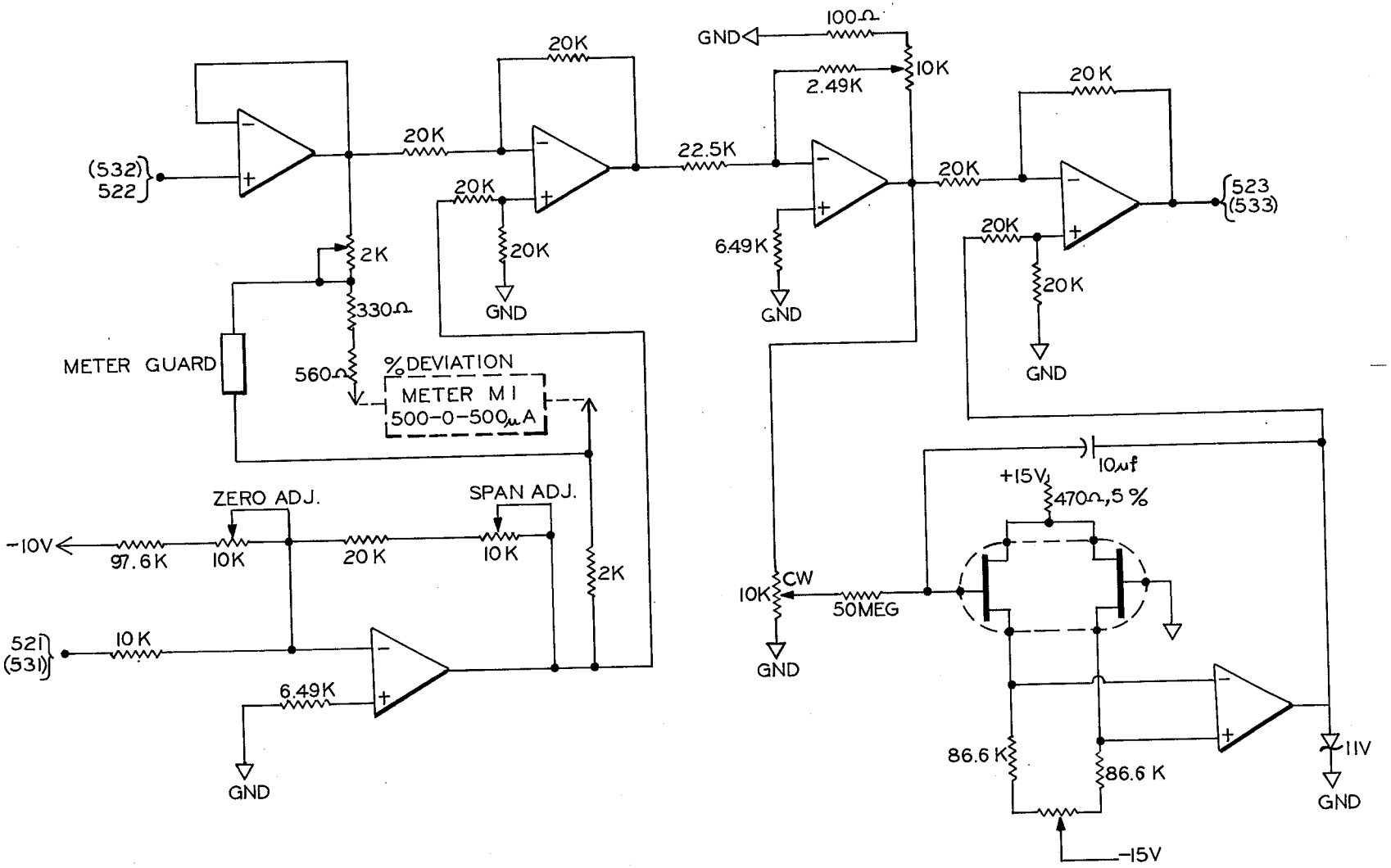
Figure 2B:
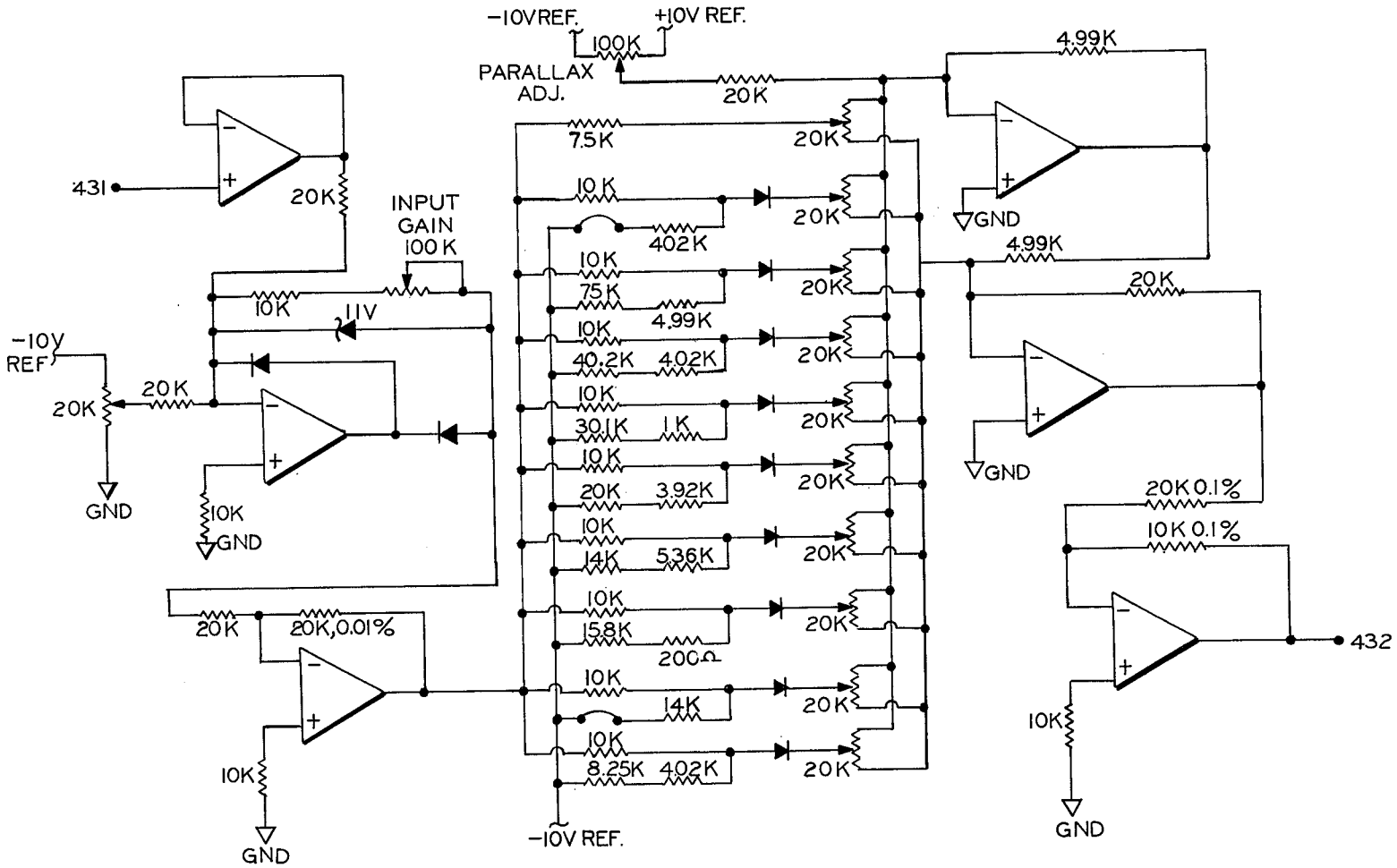
Figure 2C:
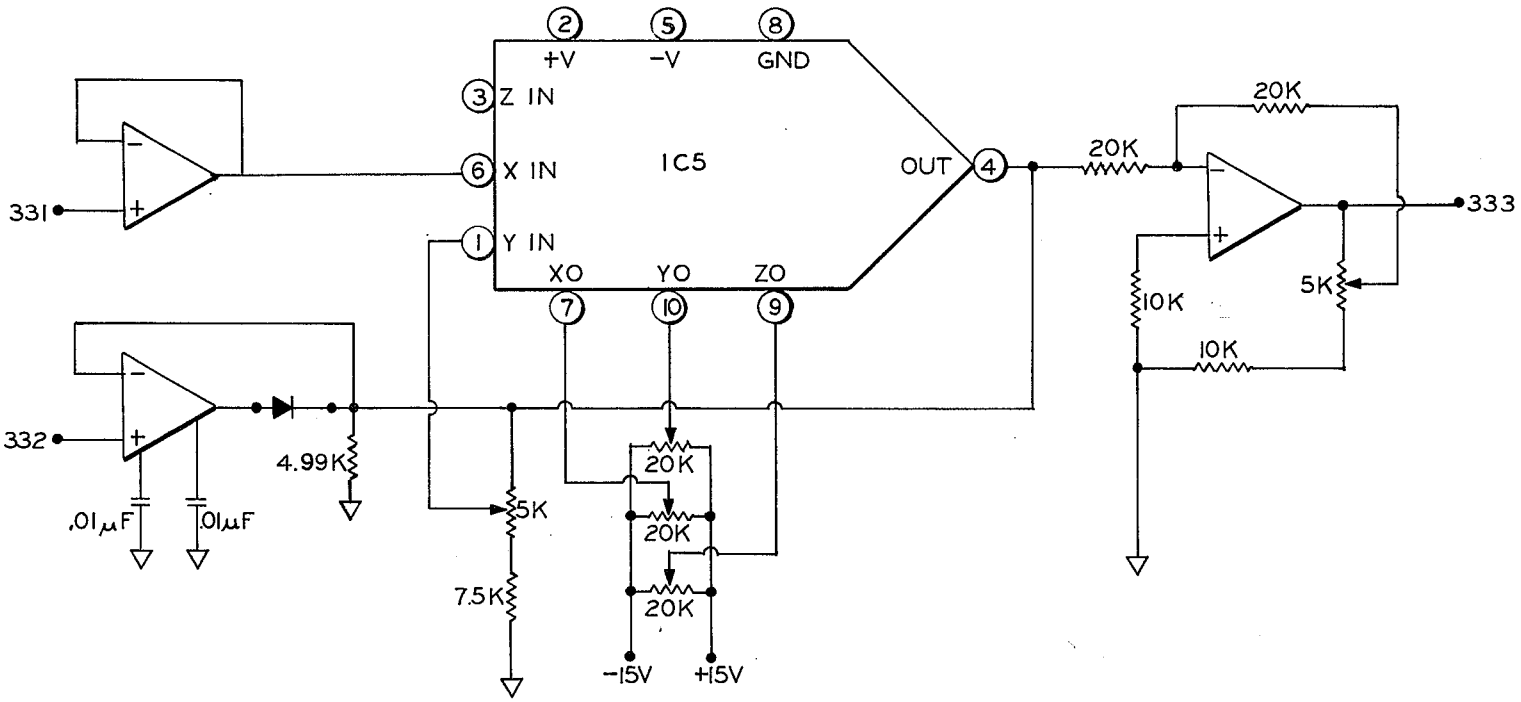

These and other objects, advantages, details, features and embodiments of this invention will become apparent to those skilled in the art from the following detailed description of the invention, the appended claims and the drawings in which FIG. 1 shows a schematical sketch of a fluid catalytic cracker and the control system, and FIGS. 2*a–c* show a schematic outline of the analog electrical circuitry of this control system.

In accordance with this invention, there is now provided a process for catalytically cracking hydrocarbons. In this process a hydrocarbon feed stream is introduced together with a cracking catalyst into a riser maintained under cracking conditions. A mixture of hydrocarbons and catalyst is passed through the riser and into a reactor vessel in which a catalyst bed is established, as well as a gas phase comprising hydrocarbons above this catalyst bed. From this gas phase a hydrocarbon product stream is withdrawn from further processing. The catalytic cracking process in accordance with this invention is provided with a temperature control. This process involves measuring the temperature of the catalyst bed and generating a bed temperaure signal. This bed temperature signal is compared with a bed temperature setpoint signal, and a riser temperature setpoint signal is generated responsive to this comparison. The temperature of the hydrocarbon/catalyst mixture in the riser is also measured and a riser temperature signal is generated responsive thereto. The riser temperature signal then is compared with the riser setpoint signal mentioned above and a catalyst flow control signal is generated responsive thereto. This catalyst flow control signal is then finally utilized to control the flow of the cracking catalyst into the riser such as to maintain an approximately constant temperature both in the riser and in the reactor vessel or regenerator bed. The control steps are preferably carried out automatically. Thus the temperature measurements and the comparison steps are automatically carried out. This is particularly conveniently done in an analog computer or by analog electrical circuitry. Preferably both the riser temperature signal and the catalyst flow control signal are generated each in a PI controller. The PI controller generates an output signal S from an input signal I (bed temperature signal for one controller and riser temperature signal for the other controller) and from a setpoint signal SP in accordance with the following equation:

$$S = A\,[(I - SP) + B \int (I - SP)dt] \qquad (1)$$

In the preferred embodiment of this invention, a stream of spent catalyst is withdrawn from the reactor vessel mentioned above and the hydrocarbons entrained in this catalyst are stripped from this spent catalyst to produce a stripped, spent catalyst stream. This stripped, spent catalyst stream is free of normally liquid or gaseous hydrocarbons and is introduced into contact with a free oxygen-containing gas in a regenerator maintained under regeneration conditions. From this regenerator a regenerated cracking catalyst stream is withdrawn and this stream is reintroduced into the riser as at least part of a catalyst stream. In this procedure a cyclic operation is maintained and a high degree of stability is reached because the combustion of the coke on the catalyst is combusted such as to heat the catalyst and to regenerate it. The more regenerated catalyst is introduced into the riser, the higher the temperature of the catalyst/hydrocarbon mixture rises. In accordance with the preferred embodiments of this process, the bed temperature signal and a bed temperature setpoint signal are converted into an output signal utilized later as the riser temperature setpoint signal in a first proportional integral controller. This first PI controller generates this output signal additively composed of a proportional component and an integral component in accordance with formula (1)

above. For converting the riser temperature signal and the riser temperature setpoint signal (output of the first PI controller) into the catalyst flow control signal, a second proportional integral controller is provided for. This second controller converts the input and setpoint signal to an output signal in accordance with the same general equation (1) given above. The constants A and B for the two controllers are $A_1$ or $A_2$ and $B_1$ or $B_2$, respectively. $A_2$ is larger than $A_1$ and $B_2$ is larger than $B_1$. This relationship can also be characterized by the fact that the first proportional integral controller has low gain and low reset to provide for a slow response and minimum chances for temperature overshoot in the riser. Correspondingly, the second proportional integral controller is a high gain, high reset controller. In this preferred embodiment, the fact that the reactor bed temperature controller is slower reacting than the riser temperature controller achieves the result that long term changes caused, e.g., by the feedstock or by the catalyst itself, can be compensated for whereas the momentary operation conditions are kept constant by the fast reacting riser temperature controller. The actual values of $A_1$, $A_2$, $B_1$ and $B_2$ depend upon the particular design and operational characteristics of the riser cracker to be controlled.

The further problem of this invention that a given manipulation of a valve in the line through which the catalyst flows into the riser does not always cause the same change in riser temperature (non-linearity of the valve) is solved by a further embodiment of this invention. In accordance therewith the catalyst flow control signal which is representative of the desired position of the catalyst valve and a signal representative of the riser temperature are converted to the riser temperature signal by a variable function generator and a multiplying unit. The variable function generator delivers an output signal responsive to the catalyst flow control signal which output signal is multiplied with the signal representative of the riser temperature. The output signal is generated so that the desired change of the riser temperature will be actually caused by the change of the catalyst valve position corresponding to the catalyst flow control signal. The riser temperature signal is the product of the output signal and the signal representative of the riser temperature.

Additionally, an apparatus for controlling a fluid catalytic cracker is provided in accordance with this invention. This apparatus comprises reactor bed temperature sensing means operatively connected to means for generating a reactor bed temperature signal representative of the reactor bed temperature. These signal generating means in turn are connected to one input of a first controller generating a signal of the first output thereof corresponding to the difference between the reactor bed temperature and a given setpoint. The first output of this controller is connected to the input of a second controller. The apparatus is further provided with means for generating a riser temperature signal, which are connected to the variable input of the second controller. The second controller is also provided with a second output which in turn is connected to means capable of manipulating the flow of catalyst into a catalytic cracker. The second controller generates an output signal corresponding to the difference between the riser temperature signal and the output signal of the first controller.

A preferred embodiment of the control apparatus of this invention comprises a variable function generator, the input of which is connected to the second output of the second controller, said function generator having a function output. This function output is connected to one input of a multiplier. This multiplier has an output delivering a signal which is the product of the signals at the two inputs thereof. The second input of this multiplier is connected to a generating unit which generates a signal representative of the riser temperature. The output of the multiplier is connected to the input of the second controller. The variable function generator is used to compensate for the non-linear relationship of riser temperature changes and catalyst flow control signal changes. Such a non-linear relationship can, e.g., be caused by a non-linear relationship between the position of a valve controlling the catalyst flow and the actual catalyst flow.

Further details and preferred embodiments of this invention will become apparent from the following description of the drawing.

FIG. 1 of the drawings schematically shows a catalytic cracker with the control system of this invention. In a catalytic cracker reactor 1, a catalyst layer reservoir 2 is established. Regenerated catalyst is introduced into the reactor 1 via a riser pipe 3. Hydrocarbon feedstock to be cracked is introduced into this riser pipe via a pipe 4. Cracked hydrocarbons are withdrawn from the catalytic cracker 1 via pipe 5, catalyst fines being separated from the gaseous effluent by a cyclone 6. Spent catalyst is withdrawn from the cracker 1 via a pipe 7. This spent catalyst, after stripping with, e.g., steam, is introduced into a regenerator shown in FIG. 1 in which the spent catalyst is regenerated and after the regeneration is reintroduced into the riser pipe 3 by way of pipe 8 and valve 9.

In the control process and system of this invention, the temperature of the catalyst/hydrocarbon mixture in the riser pipe 3 and the temperature in the catalyst bed 2 are sensed and utilized for controlling the flow of regenerated catalyst into the riser pipe 3 by manipulating valve 9. The temperature in the riser pipe 3 is sensed by a thermocouple 13, the voltage of which is converted into a voltage compatible with the downstream controllers in an amplifier 23. The output of this amplifier 23 is multiplied in a multiplying unit 33 with a valve provided from a function generator 43 as will be explained later. The amplifier 23, multiplying unit 33 and function generator 43, connected as herein described, comprise a second adaptor. The output of multiplier 33, or second adaptor output, is connected to the variable input of a proportional-integral controller 53. The output of this proportional-integral controller carries a voltage which is related to the input voltage of the proportional integral controller and the setpoint voltage of the proportional integral controller by the equation:

$$S = A[(I - SP) + B \int (I - SP)dt]$$

wherein $S$ is the output voltage of the proportional integral controller, $I$ is the variable input voltage, $SP$ is the setpoint voltage and $A$ is the proportional gain and $B$ is the integral gain of the proportional integral controller. The setpoint voltage for the proportional integral controller 53 is obtained as the output voltage of another proportional integral controller 52, the function of which will be explained later. The output voltage of the controller 53, which is the riser temperature controller, is converted in a universal output circuit 59 into a current signal which in turn is converted in an I/P converter 60 into a pneumatic signal which adjusts valve 9 to the desired position. The universal output circuit 59 and I/P converter 60, connected as described, comprise an adapting unit having a voltage input connected to the second output of the controller 53 and a pneumatic output connected to the valve 9. The universal output circuit is described in detail in the U.S. Pat. No. 3,644,752, the transducer being controller 53 connected to input "11" and the I/P converter 60 being the load "22" in the drawing of said patent.

The temperature of the catalyst bed 2 is determined by thermocouple 12, the voltage of which in turn is converted into a voltage compatible with the proportional integral controller 52 in a first adapter comprising an amplifier 22. The output of this amplifier 22 is connected to the variable input 521 (regenerator bed temperature signal) of the proportional integral controller 52. The setpoint input of the controller 52, which is the catalyst bed temperature controller, is connected to a setpoint voltage source 32 (regenerator bed temperature setpoint signal). This setpoint voltage 32 can be either a manually adjustable setpoint or it can be furnished by a computer calculation.

The output of the riser temperature controller 53 is also connected to the input of a variable function generator 43. The output of this variable function generator 43 is connected to the second input of the multiplier 33. The variable function generator 43 is designed to generate an output signal that compensates for the non-linear characteristics of the control system. In particular the output voltage generated by this variable function generator 43 is such that the manipulation of valve 9 carried out by the resulting output signal of the riser temperature controller 53, is of that size that will bring the riser temperature in the riser pipe 3 to the desired value. The variable function generator 43 thus operates to compensate for the non-linear valve characteristics.

The proportional integral controllers 52 and 53 are essentially the same analog circuits. An example for such a proportional integral controller is shown in FIG. *2a*. In this figure the inputs and outputs of the proportional integral controllers of FIG. 1 are shown. Thus 531 is the variable input of the proportional integral controller 53, and 521 the corresponding input of the controller 52, 532 the setpoint input of controller 53, and 522 the setpoint input of controller 52 and finally 533, the output of controller 53 and 523 (riser temperature setpoint signal), the output of controller 52. The positions of the sliding contacts of potentiometers PG and RA are different in the two proportional integral controllers 52 and 53. The potentiometer PG controls the proportional gain or the factor A in the equation (1) whereas the potentiometer RA controls the integral component of the control output or the factor B in the equation (1). By adjusting the positions of the potentiometers PG and RA of the operational amplifiers 52 and 53, the controller 53 is made a high gain and high reset controller which achieves fast response to changes in the temperature of the riser 3; opposite thereto the controller 52 is a low gain, low reset controller which provides a slow response to changes in the catalyst bed 12 and effectively prevents riser temperature overshoots. The terms "high" and "low" are, of course, only meaningful as a characterization of the controllers 52 and 53 relative to each other.

The multiplying unit 33 is shown schematically in FIG. *2c*. The voltages of the two inputs 331 and 332 are multiplied to result in an output voltage at the output 333 (riser temperature signal) being essentially the product of the two voltages at the inputs 331 and 332. This circuit shown also is composed of standard circuitry and self-explanatory. The operational amplifiers in this circuit (triangles) function in the manner well known and the multi-use circuit 1C5 is commercially available as AD530LH from Analog Devices, Inc., Norwood (Mass.). This circuit is connected to furnish an output voltage being 0.1 times the product of the input voltages.

The variable function generator 43 is shown in FIG. *2b*. The input voltage at the input 431 is converted by this variable function generator 43 into a voltage at the output 432. This voltage at the output 432 is related to the input voltage 431 in the non-linear manner. The functional relationship between the input and the output voltage is controlled by the position of the ten 20K potentiometers shown in the drawing. The particular functional relationship depends upon the particular riser and slide valve characteristics.

In all the circuits shown, the operational amplifiers (triangles) are those commercially available as μA741A from the Fairchild Corp. The diode in the multiplier circuit of FIG. *2c*, as well as the diodes in the variable function generator FIG. *2b* are commercially available under the designation 1N914 from Motorola, Inc. The two transistors shown in FIG. *2a* in a dotted line and having their gates connected to the 50 MEG resistor or to ground, respectively, are junction field effect transistors commercially from Motorola, Inc. under the designation 2N3955.

The thermocouples 12 and 13 are commercially available from the Foxboro Corp. under the trademark Foxboro Pyod and Iron-Constantan Thermocouples. These units are provided with an amplifier 23 or 22, respectively, which delivers a voltage of 25–30 millivolts at the output thereof, corresponding to the temperature range of the thermocouples of 900° to 1000° F. The I/P converter 60 converts the current signal into a 3–15 psi pneumatic pressure signal for driving motor valve 9. This motor valve is commercially available as a unit Stabilflo Control Valve, from the Foxboro Co., Foxboro, Mass.

Reasonable variations and modifications, which will become apparent to those skilled in the art, can be made in this invention without departing from the spirit and scope thereof.

We claim:

1. A process for catalytically cracking a hydrocarbon feed stream comprising a. introducing a hydrocarbon feed stream and a cracking catalyst stream into contact with each other and into a riser maintained under cracking conditions to produce a hydrocarbon/catalyst mixture, b. passing said hydrocarbon/catalyst mixture through said riser and into a reactor vessel to establish a catalyst bed in said vessel and a gas phase comprising hydrocarbons above said bed, c. withdrawing a hydrocarbon product stream from said gas phase for further processing, d. measuring the temperature of said catalyst bed and generating a bed temperature signal, e. comparing said bed temperature signal with a bed temperature setpoint signal and generating a riser temperature setpoint signal responsive thereto, f. measuring the temperature of said hydrocarbon/-catalyst mixture into said riser and generating a riser temperature signal responsive thereto, g. comparing said riser temperature signal with said riser temperature setpoint signal and generating a catalyst flow control signal responsive thereto, and h. controlling the flow rate of said catalyst in said catalyst stream responsive to said catalyst flow control signal such as to maintain an approximately constant temperature in said riser and said reactor vessel.

2. A process in accordance with claim 1 comprising withdrawing a stream of spent catalyst from said reactor vessel, a. stripping hydrocarbon from said catalyst stream to produce a stripped, spent catalyst stream essentially free of normally liquid or gaseous hydrocarbons, b. introducing said stripped hydrocarbon stream into contact with a free oxygen-containing gas and into a regenerator maintained under regeneration conditions such as to regenerate said cracking catalyst, and c. withdrawing a regenerated catalyst stream from said regenerator and reintroducing said regenerated catalyst stream into said riser as at least part of said catalyst stream.

3. A process in accordance with claim 1 wherein said bed temperature signal is converted into said riser temperature setpoint signal in a first proportional integral controller generating an output signal $S_1$, related to the difference between the bed temperature signal $I_1$ and a bed temperature setpoint signal $SP_1$ by the equation $$S_1 = A_1[(I_1 - SP_1) + B_1 \int (I_1 - SP_1)dt]$$

and wherein said riser temperature signal $I_2$ and said riser temperature setpoint signal $S_1$ are converted into said catalyst flow control signal $S_2$ in a second proportional integral controller generating as an output signal said catalyst flow control signal related to the riser temperature signal $I_2$ and the riser temperature setpoint signal $S_1$ by the following equation $$S_2 = A_2[(S_2 - S_1) + B_2 \int (S_2 - S_1)dt]$$

with the further provision that $A_2 > A_1$ and $B_2 > B_1$.

4. A process in accordance with claim 1 wherein said riser temperature signal is generated by multiplying a first signal, which is proportional to the riser temperature and a second signal which is generated by a variable function generator to the input of which said catalyst flow control signal is supplied, said variable function generator being designed so that the riser temperature signal generated causes a change of flow of catalyst which is the same as that necessary to reset the riser temperature from the actual value to the riser temperature setpoint value.

5. An apparatus for controlling the operation of a catalytic cracker comprising:

a. a first temperature sensing unit capable of sensing the temperature in the bed of a catalytic cracker and having a first output, b. a second temperature sensing unit capable of sensing the temperature in the riser of a catalytic cracker, and having a second output, c. a first controller having a first input, a first setpoint input and a first controller output, said first input being connected to said first output, said first setpoint input being connected to a setpoint source, d. a second controller having a second input, a second setpoint input and a second controller output, said second input being connected to said second output, said second setpoint input being connected to said first controller output, and e. an adapting unit having an adapting input and adapting output, said adapting input being connected to said second controller output and said adapting output being capable of delivering a signal for manipulating a valve.

6. An apparatus in accordance with claim 5 wherein said first controller is an analog electrical PI controller generating a signal $S_1$ at said first controller output being related to an input signal $I_1$ at said first input and a setpoint signal $SP_1$ at said first setpoint input by the equation $$S_1 = A_1[(I_1 - SP_1) + B_1 \int (I_1 - SP_1)dt]$$

and wherein said second controller is an analog electrical PI controller generating a signal $S_2$ at said second controller output being related to said signal $S_1$ and to an input signal $I_2$ by the equation $$S_2 = A_2[(I_2 - S_1) + B_2 \int (I_2 - S_1)dt]$$

wherein $A_1$, $A_2$, $B_1$ and $B_2$ are gain factors related to each other by the relationships that $A_2$ is larger than $A_1$ and $B_2$ is larger than $B_1$.

7. An apparatus in accordance with claim 6 wherein said second temperature sensing unit comprises a variable function generator having a function input and a function output, said function input being connected to said second controller output, and a multiplier having two multiplicator inputs and one multiplier output, the first multiplicator input being connected to the function output and the second multiplicator input being connected to a signal source delivering a signal proportional to a sensed temperature, and wherein said multiplier output constitutes said second output.

8. A catalytic cracker comprising a. a cracker vessel, b. a riser pipe extending essentially vertically into said cracker vessel, c. a catalyst feed pipe provided with a valve, said feed pipe being connected to said riser, d. a first temperature sensor arranged within said cracking vessel at a location where a catalyst layer during normal operation is established, e. a second temperature sensor arranged within said riser pipe, f. a first adaptor connected to said first temperature sensor to generate a catalyst bed temperature signal at the first adaptor output compatible with the downstream equipment, g. a second adaptor connected to said second temperature sensor generating a riser temperature signal at the second adaptor output compatible with the downstream equipment, h. a first controller having a first input, a first setpoint input and a first controller output, said first input being connected to said first adaptor output and said first setpoint input being connected to a setpoint source, i. a second controller having a second input, a second setpoint input and a second controller output, said second input being connected to said second adaptor output, said second setpoint input being connected to said first controller output, and j. an adapting unit having an adapting input and an adapting output, said adapting unit being connected to said second controller output and said adapting output being capable of delivering a signal for manipulating a valve.

9. An apparatus in accordance with claim 8 wherein said first controller is an analog electrical PI controller generating a signal $S_1$ at said first controller output being related to an input signal $I_1$ at said first input and a setpoint signal $SP_1$ at said first setpoint input by the equation $$S_1 = A_1[(I_1 - SP_1) + B_1 \int (I_1 - SP_1)dt]$$

and wherein said second controller is an analog electrical PI controller generating a signal $S_2$ at said second controller output being related to said signal $S_1$ and to an input signal $I_2$ by the equation $$S_2 = A_2[(I_2 - S_1) + B_2 \int (I_2 - S_1)dt]$$

wherein $A_1$, $A_2$, $B_1$ and $B_2$ are gain factors related to each other by the relationships that $A_2$ is larger than $A_1$ and $B_2$ is larger than $B_1$.

10. An apparatus in accordance with claim 9 wherein said second adaptor comprises a variable function generator having a function input and a function output, said function input being connected to said second controller output and a multiplier unit having two multiplicator inputs and one multiplier output, the first multiplicator input being connected to the function output and the second multiplicator input being connected to a signal source delivering a signal proportional to the temperature sensed in the riser pipe which signal source is connected to said second temperature sensor, and wherein said multiplier output constitutes said second adaptor output.

* * * * *